US006176219B1

(12) United States Patent
Culbertson

(10) Patent No.: US 6,176,219 B1
(45) Date of Patent: Jan. 23, 2001

(54) ENGINE THROTTLE CONTROL DEVICE

(76) Inventor: Tony C. Culbertson, 17928 Street, Rte. 56, Laurelville, OH (US) 43135

( * ) Notice: Under 35 U.S.C. 154(b), the term of this patent shall be extended for 0 days.

(21) Appl. No.: 09/296,309

(22) Filed: Apr. 22, 1999

(51) Int. Cl.[7] ..... F02D 11/10
(52) U.S. Cl. ..... 123/399; 123/400
(58) Field of Search ..... 123/396, 397, 123/398, 399, 361, 400

(56) References Cited

U.S. PATENT DOCUMENTS

| | | | | |
|---|---|---|---|---|
| 4,909,214 | * | 3/1990 | Shirakawa | 123/399 |
| 5,168,951 | * | 12/1992 | Sugiura et al. | 123/399 |
| 5,269,273 | * | 12/1993 | Yasuda et al. | 123/399 |
| 5,642,712 | * | 7/1997 | Biondo | 123/396 |
| 5,833,578 | * | 11/1998 | Potis | 123/399 |
| 5,855,196 | * | 1/1999 | Hawley | 123/398 |
| 6,039,027 | * | 3/2000 | Sato et al. | 123/399 |

* cited by examiner

*Primary Examiner*—Willis R. Wolfe

(57) ABSTRACT

A engine throttle control device for permitting a user to control the opening and closing of the throttle valve of a carburetor (or the fuel pump of a diesel engine) remotely from the passenger compartment of the vehicle to increase the RPM of the engine. The engine throttle control device includes a pivotally mounted actuator arm pivotable at a pivot axis between a first and second pivot positions. The actuator arm is operatively connected to a fuel delivery device for delivering fuel to a combustion engine. The delivery of fuel to the combustion engine by the fuel delivery device is increased as the actuator arm is pivoted towards the first pivot position. Conversely, the delivery of fuel to the combustion engine by the fuel delivery device is decreased as the actuator arm is pivoted towards the second pivot position. A motor is connected to the actuator arm for pivoting the actuator arm between the first and second pivot positions. The motor has a remote controller switch electrically connected thereto to permit selective activation of the motor.

10 Claims, 2 Drawing Sheets

22
24
23

20
21
12
22
23
14
13

ENGINE THROTTLE CONTROL DEVICE

BACKGROUND OF THE INVENTION

1. Field of the Invention

The present invention relates to devices for controlling the RPM of a combustion engine and more particularly pertains to a new engine throttle control device for permitting a user to control the opening and closing of the throttle valve of a carburetor (or the fuel pump of a diesel engine) remotely from the passenger compartment of the vehicle to increase the RPM of the engine.

2. Description of the Prior Art

The use of devices for controlling the RPM of a combustion engine is known in the prior art. More specifically, devices for controlling the RPM of a combustion engine heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,577,603 by Murakami et al.; U.S. Pat. No. 5,333,585 by Kuroda; U.S. Pat. No. 4,938,180 by King; U.S. Pat. No. 4,838,223 by Tanabe et al.; U.S. Pat. No. 4,261,308 by Hadekel et al.; and U.S. Pat. No. Des. 298,228 by Hoshino which are all incorporated by reference herein.

While these devices fulfill their respective, particular objectives and requirements, the aforementioned patents do not disclose a new engine throttle control device. The inventive device includes a pivotally mounted actuator arm pivotable at a pivot axis between a first and second pivot positions. The actuator arm is operatively connected to a fuel delivery device for delivering fuel to a combustion engine. The delivery of fuel to the combustion engine by the fuel delivery device is increased as the actuator arm is pivoted towards the first pivot position. Conversely, the delivery of fuel to the combustion engine by the fuel delivery device is decreased as the actuator arm is pivoted towards the second pivot position. A motor is connected to the actuator arm for pivoting the actuator arm between the first and second pivot positions. The motor has a remote controller switch electrically connected thereto to permit selective activation of the motor.

In these respects, the engine throttle control device according to the present invention substantially departs from the conventional concepts and designs of the prior art, and in so doing provides an apparatus primarily developed for the purpose of permitting a user to control the opening and closing of the throttle valve of a carburetor (or the fuel pump of a diesel engine) remotely from the passenger compartment of the vehicle to increase the RPM of the engine.

SUMMARY OF THE INVENTION

In view of the foregoing disadvantages inherent in the known types of devices for controlling the RPM of a combustion engine now present in the prior art, the present invention provides a new engine throttle control device construction wherein the same can be utilized for permitting a user to control the opening and closing of the throttle valve of a carburetor (or the fuel pump of a diesel engine) remotely from the passenger compartment of the vehicle to increase the RPM of the engine.

The general purpose of the present invention, which will be described subsequently in greater detail, is to provide a new engine throttle control device apparatus and method which has many of the advantages of the devices for controlling the RPM of a combustion engine mentioned heretofore and many novel features that result in a new engine throttle control device which is not anticipated, rendered obvious, suggested, or even implied by any of the prior art devices for controlling the RPM of a combustion engine, either alone or in any combination thereof.

To attain this, the present invention generally comprises a pivotally mounted actuator arm pivotable at a pivot axis between a first and second pivot positions. The actuator arm is operatively connected to a fuel delivery device for delivering fuel to a combustion engine. The delivery of fuel to the combustion engine by the fuel delivery device is increased as the actuator arm is pivoted towards the first pivot position. Conversely, the delivery of fuel to the combustion engine by the fuel delivery device is decreased as the actuator arm is pivoted towards the second pivot position. A motor is connected to the actuator arm for pivoting the actuator arm between the first and second pivot positions. The motor has a remote controller switch electrically connected thereto to permit selective activation of the motor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new engine throttle control device apparatus and method which has many of the advantages of the devices for controlling the RPM of a combustion engine mentioned heretofore and many novel features that result in a new engine throttle control device which is not anticipated, rendered obvious, suggested, or even implied by any of the prior art devices for controlling the RPM of a combustion engine, either alone or in any combination thereof.

It is another object of the present invention to provide a new engine throttle control device which may be easily and efficiently manufactured and marketed.

It is a further object of the present invention to provide a new engine throttle control device which is of a durable and reliable construction.

An even further object of the present invention is to provide a new engine throttle control device which is susceptible of a low cost of manufacture with regard to both materials and labor, and which accordingly is then susceptible of low prices of sale to the consuming public, thereby making such engine throttle control device economically available to the buying public.

Still yet another object of the present invention is to provide a new engine throttle control device which provides in the apparatuses and methods of the prior art some of the advantages thereof, while simultaneously overcoming some of the disadvantages normally associated therewith.

Still another object of the present invention is to provide a new engine throttle control device for permitting a user to control the opening and closing of the throttle valve of a carburetor (or the fuel pump of a diesel engine) remotely from the passenger compartment of the vehicle to increase the RPM of the engine.

Yet another object of the present invention is to provide a new engine throttle control device which includes a pivotally mounted actuator arm pivotable at a pivot axis between a first and second pivot positions. The actuator arm is operatively connected to a fuel delivery device for delivering fuel to a combustion engine. The delivery of fuel to the combustion engine by the fuel delivery device is increased as the actuator arm is pivoted towards the first pivot position. Conversely, the delivery of fuel to the combustion engine by the fuel delivery device is decreased as the actuator arm is pivoted towards the second pivot position. A motor is connected to the actuator arm for pivoting the actuator arm between the first and second pivot positions. The motor has a remote controller switch electrically connected thereto to permit selective activation of the motor.

Still yet another object of the present invention is to provide a new engine throttle control device that allows an operator to increase the RMP of a vehicle engine as needed. This is especially helpful when the vehicle has a secondary device that is powered by the vehicle's engine such as a winch of a tow truck or a water pump of a fire truck. This device allows the operator standing outside of the passenger compartment of the vehicle to increase the RPM of the idling engine to provide extra power to the secondary device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
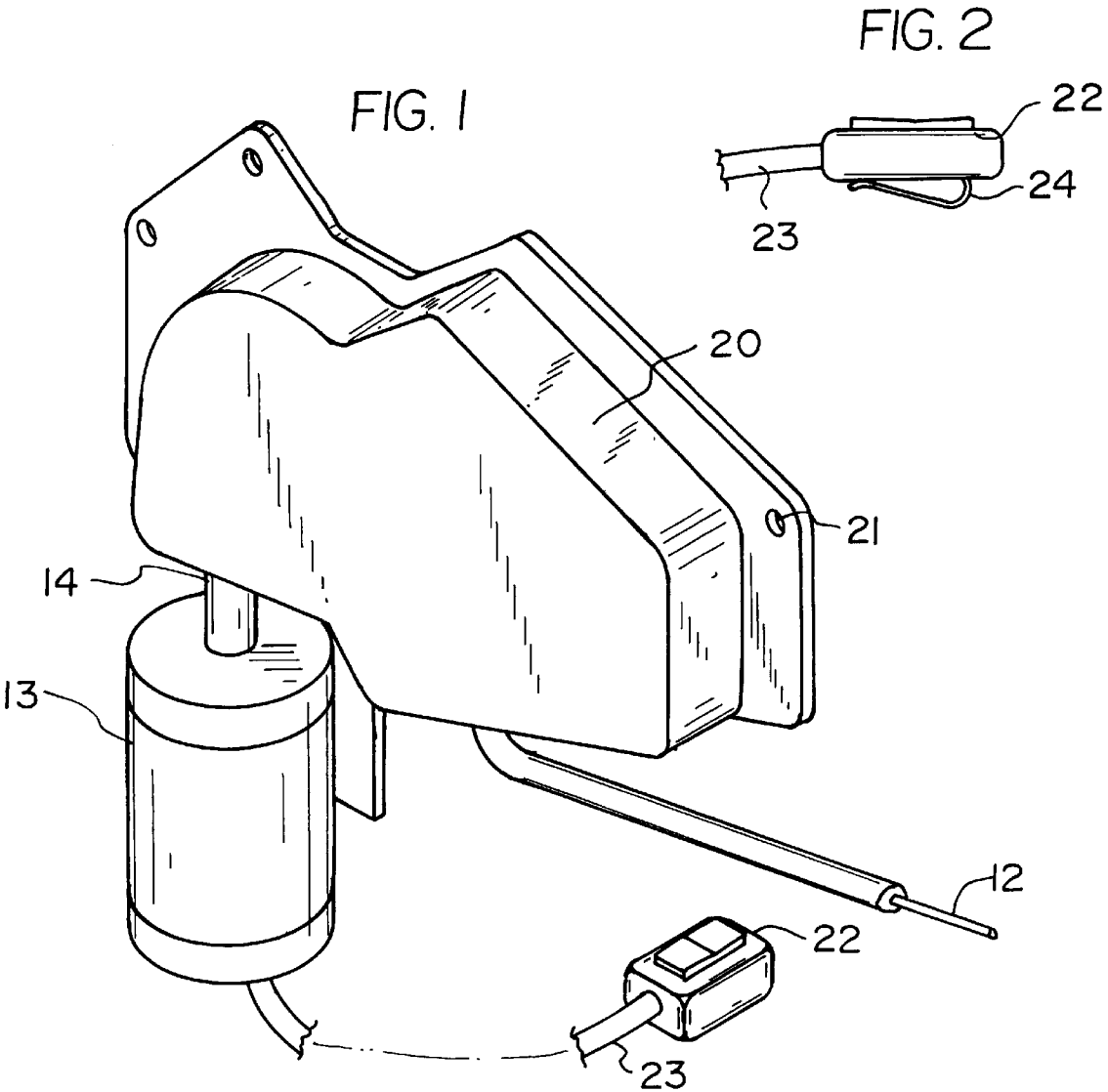
FIG. 1 is a schematic perspective view of a new engine throttle control device according to the present invention.
FIG. 2 is a schematic side view of the remote controller switch of the present invention.

With reference now to the drawings, and in particular to FIGS. 1 through 4 thereof, a new engine throttle control device embodying the principles and concepts of the present invention will be described.

As best illustrated in FIGS. 1 through 4, the engine throttle control device generally comprises a pivotally mounted actuator arm pivotable at a pivot axis between a first and second pivot positions. The actuator arm is operatively connected to a fuel delivery device for delivering fuel to a combustion engine. The delivery of fuel to the combustion engine by the fuel delivery device is increased as the actuator arm is pivoted towards the first pivot position. Conversely, the delivery of fuel to the combustion engine by the fuel delivery device is decreased as the actuator arm is pivoted towards the second pivot position. A motor is connected to the actuator arm for pivoting the actuator arm between the first and second pivot positions. The motor has a remote controller switch electrically connected thereto to permit selective activation of the motor.

In closer detail, the engine throttle control device is designed for remotely controlling the amount of fuel delivered to a vehicle's combustion engine by a fuel delivery device of the vehicle's combustion engine such as a throttle valve of a carburetor or a fuel pump of a fuel injector. In closer detail, the engine throttle control device comprises a pivotally mounted actuator arm 10 pivotable at a pivot axis 11 between a first and second pivot positions. The actuator arm is operatively connected by an elongate cable 12 to a fuel delivery device such as a carburetor or a fuel injector for delivering fuel to a combustion engine. In use, the delivery of fuel to the combustion engine by the fuel delivery device is increased as the actuator arm is pivoted towards the first pivot position to thereby increase the RPM of the combustion engine. Conversely, the delivery of fuel to the combustion engine by the fuel delivery device is decreased as the actuator arm is pivoted towards the second pivot position to thereby decrease the RPM of the combustion engine.

A motor 13 is provided for pivoting the actuator arm between the first and second pivot positions. The motor is preferably electrically connected to the electrical power supply of the vehicle. The motor has a rotating shaft 14 with a worm gear 15 thereon. The actuator arm has a toothed end 16 distal the pivot axis of the actuator arm. At least one rotatably mounted toothed connecting gear operatively engages the worm gear of the rotating shaft to the toothed end of the actuator arm. Preferably, coaxial first and second connecting gears 17,18 are rotatably mounted on an axle 19 and coupled together such that rotation of either connecting gear rotates the other connecting gear. The first connecting gear 17 has an outer diameter greater than the second connecting gear. The first connecting gear engages the worm gear. The second connecting gear engages the toothed end of the actuator arm.

In use, rotation of the rotating shaft in a first direction pivots the actuator arm towards the first pivot position via the worm gear, connecting gear and the toothed end of the actuator arm. Similarly, rotation of the rotating shaft in a second direction opposite the first direction pivots the actuator arm towards the second pivot position via the worm gear, connecting gear and the toothed end of the actuator arm.

Figure 3:
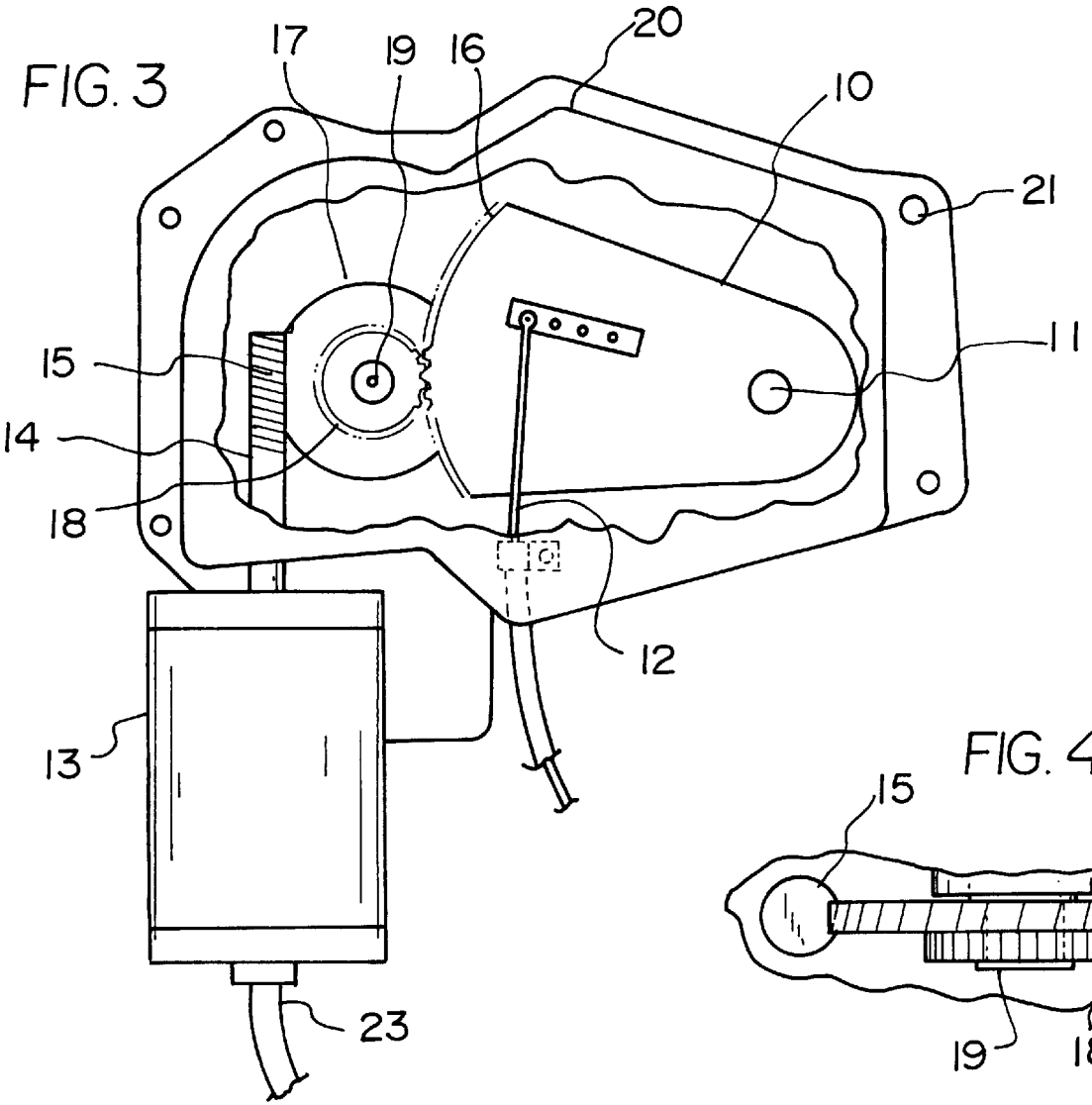
FIG. 3 is a schematic breakaway side view of the present invention.
Figure 4:
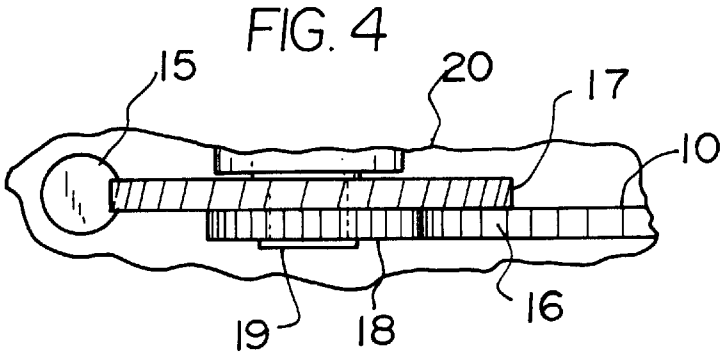
FIG. 4 is a schematic enlarged top view of the gears of the present invention.

Preferably, a housing 20 is mounted to in an engine compartment of the vehicle by fasteners extended though mounting holes 21 in the housing. As best illustrated in FIG. 3, the actuator arm, the connecting gears and the worm gear of the rotating shaft are disposed in the housing to help protect the gears from exposure to contaminants such as grease, oil, and dirt. The motor is located outside of the housing and mounted to an exterior portion of the housing. The cable connecting the actuator arm to the fuel delivery device is outwardly extended from the housing to the fuel delivery device.

The motor has a remote controller switch 22 electrically connected thereto by a length of electrical conduit 23. In use, the remote controller switch permits selective activation of the motor. The remote controller switch preferably has first, second and third positions. In use, the motor is activated to rotate the rotating shaft in the first direction when the remote controller switch is in the first position. Similarly, the motor is activated to rotate the rotating shaft in the second direction when the remote controller switch is in the second position. When the remote controller switch is in the third position, the motor is deactivated such that the rotating shaft is not rotated by the motor.

Preferably, the remote controller switch has a resilient clip 24 coupled thereto to permit detachable attachment of the remote controller to an object.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A control system for controlling a fuel delivery device of a vehicle's combustion engine such as a throttle valve of a carburetor or a fuel pump of a fuel injector, said control system comprising:

a pivotally mounted actuator arm pivotable at a pivot axis between a first and second pivot positions;

said actuator arm being operatively connected by an elongate cable to a fuel delivery device for delivering fuel to a combustion engine, whereby the delivery of fuel to the combustion engine by said fuel delivery device is increased as said actuator arm is pivoted towards said first pivot position to thereby increase the RPM of the combustion engine, and whereby the delivery of fuel to the combustion engine by said fuel delivery device is decreased as said actuator arm is pivoted towards said second pivot position to thereby decrease the RPM of the combustion engine;

a motor for pivoting said actuator arm between said first and second pivot positions;

said motor having a rotating shaft, said rotating shaft having a worm gear thereon;

said actuator arm having a toothed end distal said pivot axis of said actuator arm;

at least one rotatably mounted toothed connecting gear operatively engaging said worm gear of said rotating shaft to said toothed end of said actuator arm such that rotation of said rotating shaft in a first direction pivots said actuator arm towards said first pivot position and rotation of said rotating shaft in a second direction opposite said first direction pivots said actuator arm towards said second pivot position;

a housing being mounted to in an engine compartment of the vehicle, said actuator arm, said connecting gear and said worm gear of said rotating shaft being disposed in said housing;

said motor having a remote controller switch electrically connected thereto;

said remote controller switch permitting selective activation of said motor, said remote controller switch having first, second and third positions, wherein said motor is activated to rotate said rotating shaft in said first direction when said remote controller switch is in said first position, wherein said motor is activated to rotate said rotating shaft in said second direction when said remote controller switch is in said second position, wherein said motor is deactivated such that said rotating shaft is not rotated by said motor when said remote controller switch is in said third position; and said remote controller switch having a resilient clip coupled thereto to permit detachable attachment of said remote controller to an object.

2. A control system for controlling a fuel delivery device of a vehicle's combustion engine, said control system comprising:

a pivotally mounted actuator arm pivotable at a pivot axis between a first and second pivot positions;

said actuator arm being operatively connected to a fuel delivery device for delivering fuel to a combustion engine, whereby the delivery of fuel to the combustion engine by said fuel delivery device is increased as said actuator arm is pivoted towards said first pivot position, and whereby the delivery of fuel to the combustion engine by said fuel delivery device is decreased as said actuator arm is pivoted towards said second pivot position;

a motor for pivoting said actuator arm between said first and second pivot positions;

said motor having a remote controller switch electrically connected thereto by a length of electrical conduit, said remote controller switch permitting selective activation of said motor;

a housing, wherein said actuator arm, said connecting gear and said worm gear of said rotating shaft are disposed in an interior of said housing to protect said gears from exposure to contaminants; and said motor being mounted to an exterior portion of said housing and located outside of said housing.

3. The control system of claim 1, wherein said fuel delivery device comprises a carburetor or fuel injector.

4. The control system of claim 1, wherein said remote controller switch has a resilient clip coupled thereto.

5. The control system of claim 1, wherein said housing being mountable to an engine compartment of the vehicle, said housing having mounting holes therethrough to permit extension of fasteners through said mounting holes to mount said housing the engine compartment.

6. The control system of claim 1, wherein said actuator arm being connected to an elongate cable, said cable connecting said actuator arm to the fuel delivery device being outwardly extended from said housing to the fuel delivery device.

7. The control system of claim 1, wherein said motor has a rotating shaft, said rotating shaft having a worm gear thereon, wherein said actuator arm has a toothed end distal said pivot axis of said actuator arm, and wherein at least one rotatably mounted toothed connecting gear operatively engaging said worm gear of said rotating shaft to said toothed end of said actuator arm.

8. The control system of claim 7, wherein said rotation of said rotating shaft in a first direction pivots said actuator arm towards said first pivot position and rotation of said rotating shaft in a second direction opposite said first direction pivots said actuator arm towards said second pivot position via said worm gear, connecting gear and said toothed end of said actuator arm.

9. The control system of claim 1, wherein coaxial first and second connecting gears are rotatably mounted on an axle in said housing, said first and second connecting gears being coupled together such that rotation of either connecting gear rotates the other connecting gear.

10. The control system of claim 9, wherein said first connecting gear having an outer diameter greater than said second connecting gear, said first connecting gear engaging said worm gear, said second connecting gear engaging said toothed end of said actuator arm.

* * * * *